United States Patent [19]

Ishii

[11] 4,360,800

[45] Nov. 23, 1982

[54] GONG STRIKING MECHANISM

[75] Inventor: Tadashi Ishii, Tokyo, Japan

[73] Assignee: Kobishi Electric Co., Ltd., Tokyo, Japan

[21] Appl. No.: 157,894

[22] Filed: Jun. 9, 1980

[51] Int. Cl.[3] ..... G08B 3/10

[52] U.S. Cl. ..... 340/396; 340/399; 340/402

[58] Field of Search ..... 340/396, 399, 402, 393; 116/152, 154, 155, 157

[56] References Cited

U.S. PATENT DOCUMENTS 1,136,781 4/1915 Elliot ..... 340/399

4,286,258 8/1981 Ishii ..... 340/396

FOREIGN PATENT DOCUMENTS 701854 3/1931 France ..... 340/399

OTHER PUBLICATIONS

Helios 39, Jahrg. 1933, No. 21, Fachteil, Mar. 21, 1933.

*Primary Examiner*—John W. Caldwell, Sr.
*Assistant Examiner*—Daniel Myer
*Attorney, Agent, or Firm*—Darby & Darby

[57] ABSTRACT

Gong striking mechanism is provided, which comprises a driving electric motor mounted on a frame within a gong, conversion means rotationally connected directly or indirectly to the motor shaft for converting continuous rotational motion of the motor shaft to reciprocal gong striking motion, and resilient means adapted to absorb impact forces during gong striking motion and disposed intermediately between the motor and a hammer.

4 Claims, 15 Drawing Figures

GONG STRIKING MECHANISM

BACKGROUND OF THE INVENTION

This invention relates to an electric bell of the type which is driven by a motor and adapted for use in a fire bell, an alarm bell or the like, and more particularly to a gong striking mechanism driven by a motor to strike a gong.

In a conventional electric bell as shown in FIG. 1, a pivoting plate 2 is fixed to a motor shaft. A counter-weight 3 is attached at one end of plate 2 A striking hammer 4 is attached to the other end of plate 2 and is arranged in a slot 5 to move forwardly and backwardly against a gong 6 during the rotation of a motor 7. The location of the striking hammer 4 varies each time it strikes the gong 6 so that the weight balance between the two ends of the pivoting plate 2 with respect to the rotary shaft 1 of the motor 7 can not attain an appropriate condition and fluctuates during the hammer striking motion.

Moreover, when the motor 7 starts to rotate and the striking hammer 4 strikes the gong 6 the relatively long plate 2, having at one end the counter-weight 3 and the striking hammer 4 at the other end causes the motor shaft 1 either to bend, due to the large torque imparted thereon, or to move gradually away from the shaft 1 due to the absence of a provision for fixing the shaft 1 to the plate 2. The latter case is seen when the shaft is relatively small in diameter and is insusceptible for a fixing means such as a pin to be inserted in the shaft to fix the shaft 1 and the plate 2. Therefore, the bell of the type described is disadvantageous since the rotation of the motor 7 is not smooth and is apt to fluctuate. Further, the shaft 1 is subjected to a bending force which causes irreparable damages thereto.

In order to overcome the above disadvantage, a bell as shown in FIG. 2 has been proposed employing a cam 8 fixedly attached to an axis 9 of a motor 10 and a crank rod 11 which engages the cam so as to convert the rotational motion of the motor 10 to a reciprocal motion, thereby causing a spring plate 12 to reciprocate in order to strike a gong 13 with a hammer 14 fixedly attached to the plate 12. The spring plate 12 is fixed at one end thereof to a supporting plate 15 and is connected at the other end thereof to the crank rod 11.

In the bell as described above, however, some problems exist, such as the requirement of a plurality of assembly processes, expensive cost, and difficulty in adjusting the bell to get an optimum sound volume.

Accordingly, it is an object of this invention to provide a novel gong striking mechanism in which all of the above-described drawbacks accompanying a conventional gong striking mechanism are overcome. Another object of the invention is to provide a gong striking mechanism employing reliable and simple elements to eliminate difficulties in manufacturing the bell and adjusting the bell sound volume.

With the above and other objects in view, the invention provides a gong striking mechanism comprising a driving electric motor, mounted on a frame within a gong, and a conversion means rotationally connected directly or indirectly to the motor shaft for converting continuous rotational motion of the motor shaft to reciprocal motion of a hammer, and a resilient means adapted to absorb impact strength during gong striking motion, the resilient means being disposed between the motor shaft and the hammer. Preferably the conversion means comprises a cylindrical end cam rotatably attached to the motor shaft, and a cylindrical cam follower having one end which abuts the end surface of the cam and a second end secured to a first end of a rod. The rod being capable of reciprocating movement and having a hammer fixedly connected to a second end thereof to strike the gong. A resilient means is composed of a spring which is fixed at one end thereof to the cam follower to absorb impact force during gong striking motion. Further, it may be possible to substitute the cylindrical cam follower and the reciprocal rod for a single reciprocal rod which serves both to follow the end cam and to strike the gong, such that the single reciprocal rod abuts at one end to the end cam and at the other end abuts to and strikes the hammer. Still further the gong striking mechanism in accordance with a invention preferably comprises the resilient means which is composed of a flexible tube. One end of the flexible tube is fixedly connected to the motor shaft and the other end is connected to an eccentric came. The eccentric cam being adapted to serve as said conversion means to strike the gong. The conversion means may preferably be composed of an eccentric cam rotatably fixed to the motor shaft, the cam being disposed to engage the resilient means which includes a spring plate and a hammer.

The novel features which are considered characteristic of the invention are set forth in the appended claims. This invention itself, however, as well as other objects and advantages thereof will be best understood by reference to the following detailed description of illustrative embodiments, when read in conjunction with the accompanying drawings.

DETAILED DESCRIPTION OF THE INVENTION

Figure 1:
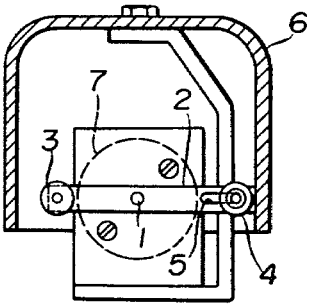
Fig.1 PRIOR ART
FIGS. 1 and 2 are a sectional side view and a bottom view illustrating examples of a conventional motor driven type bell.
Figure 2:
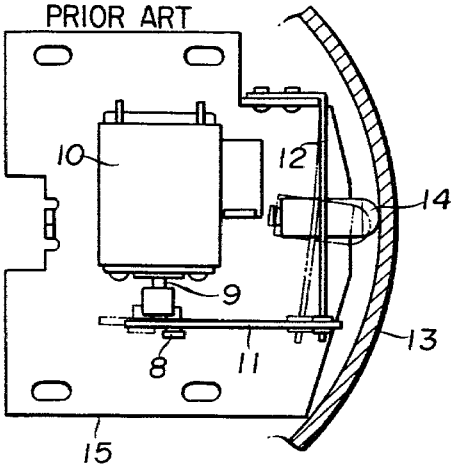
Fig.2 PRIOR ART
Figure 3:
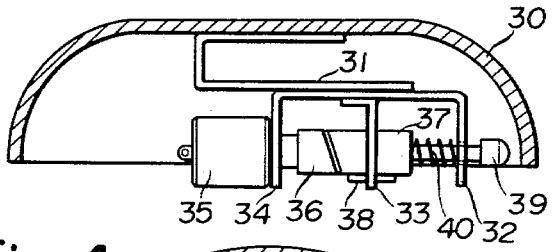
FIGS. 3 and 4 are a sectional side view and a bottom view showing a first embodiment of this invention, respectively.
Figure 4:
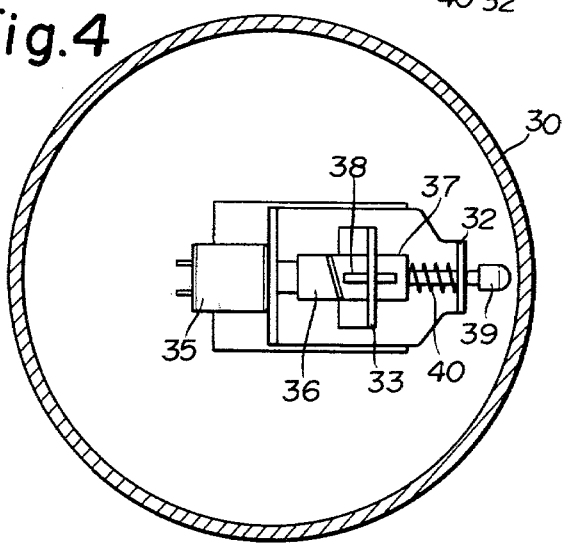

A first embodiment of this invention is shown in FIGS. 3 and 4 in which reference numeral 30 designates a gong. The gong 30 is made of iron in the form of a cup or a semisphere.

A mounting plate 31 is fixed to the central portion of the inner wall of the gong 30 with an appropriate fixing means such as a bolt or nut so the plate 31 supports three different supporting walls, i.e., a front wall 32, an intermediate wall 33, and a rear wall 34, each wall extending downwardly from the mounting plate 31. These three walls 32, 33, 34 may be made integrally from a single steel sheet by bending it suitably to accommodate a bell striking mechanism hereinunder described. Fixedly installed to the rear wall 34 is a motor 35, the shaft of which is rotatably inserted through an opening formed in the center of the wall 34. A cylindrical end cam 36 is rotatably fixed to the shaft of the motor 35. The end surface of the cam 36 engages a cylindrical cam follower 37 which is rotatably and reciprocably held through a hole formed in the intermediate wall 33, which has a groove formed on the surface of it in axial alignment with the cam follower 37. The groove incorporates an elongated pin 38 adapted to fit with a recess formed in the intermediate wall 33 so that the cam follower 37 will not be removed away from its operating range. At the opposite side of the end surface of the cam follower 37 which engages the end cam 36, there is formed a rod portion having a smaller diameter than the cam follower 37. A hammer 39 is formed at the extremity of the rod portion. The hammer 39 is disposed through a hole formed in the front wall 32 in proximate arrangement with the inner surface of the gong 30. A spring 40 is arranged between the inside of the front wall 32 closest to intermediate wall 33 and the end portion of the cam follower 37 not in engagement with the end cam 36 to absorb the impact force exerted on the cam follower 37 when the hammer 39 strikes the gong 30.

Figure 5:
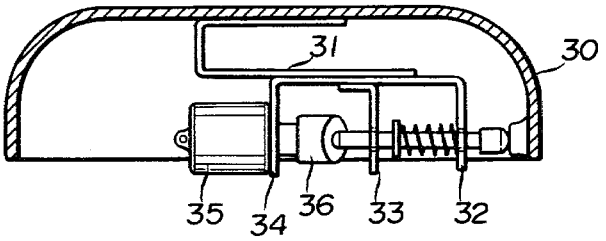
FIGS. 5 and 6 are a sectional side view and a bottom view showing a second embodiment of this invention, respectively.
Figure 6:
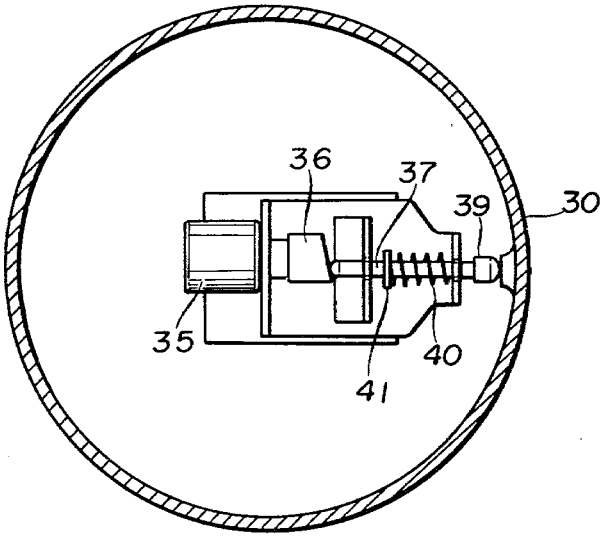

A second embodiment of the invention will be described with reference to FIGS. 5 and 6 in which reference numeral 30 designates a gong which is of the same type as described in the first embodiment. It should be understood that like parts are indicated by like reference numerals in FIGS. 3, 4, 5 and 6. The difference between the first and the second embodiment lies in that the latter is mainly composed of a cylindrical cam 36 and a cam follower 37, the cam follower 37 having at a predetermined position a protrusion 41 around its periphery. The cam follower 37 has a hammer 39 at one end with the other end of the cam follower 37 being formed to abut directly to the end surface of the cam 36. Thus, the corresponding constitutional elements of the cam follower body in the first embodiment is absent in this embodiment so that this embodiment can be operated as a bell striking mechanism with fewer components. The only difference in operation resides in that the stroke of the hammer 39 is short as compared with the first embodiment.

Figure 7:
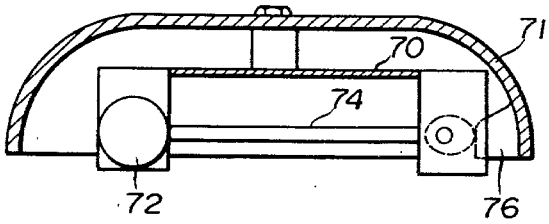
FIGS. 7 and 8 are a sectional side view and a bottom view showing a third embodiment of this invention, respectively.
Figure 8:
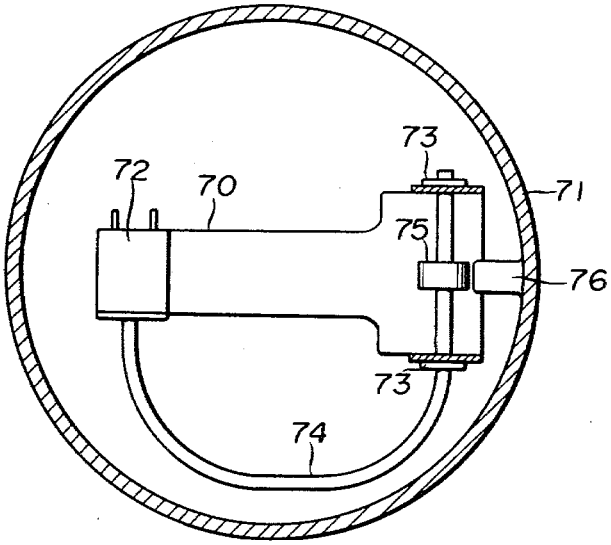

A third embodiment of the invention is shown in FIGS. 7 and 8 in which a supporting plate 70 is fixedly attached to the gong 71 at the central portion thereof, the plate being suited for supporting a motor 72 and bearings 73. A flexible wire or tube 74 is connected at one end to shaft of the motor 72 while the other end thereof is rotatably supported by the two bearings 73.

An eccentric cam 75 is fixed to the flexible wire 74. The eccentric cam 75 is positioned at a distance midway between the two bearings 73 so that the cam 75 can be arranged adjacent to a protrusion 76 formed in the inner surface of the gong wall in order to strike the protrusion 76.

Figure 9:
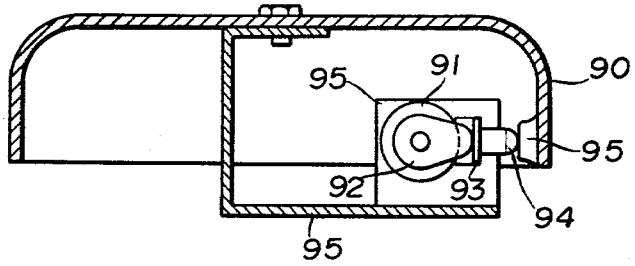
FIGS. 9 and 10 are a sectional side view and a bottom view showing a fourth embodiment of this invention, respectively.
Figure 10:
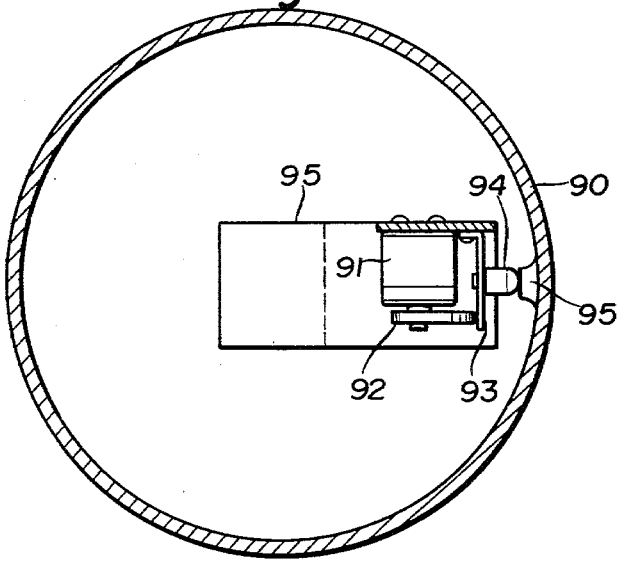
Figure 11:
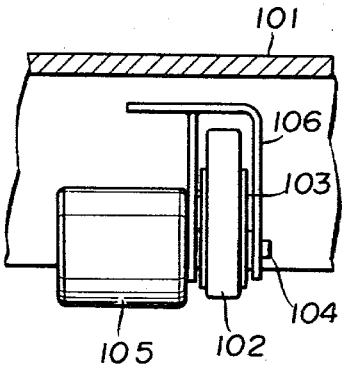
FIGS. 11 and 12 are sectional side views each showing a fifth embodiment of this invention.
Figure 12:
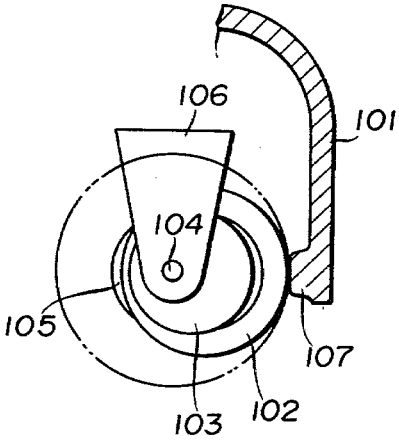

FIGS. 9 and 10 illustrate a fourth embodiment of the invention in which numeral 90 designates a gong. As is easily understood from the drawing, the embodiment is simple in construction such that there are provided only a motor 91, a cam 92 fixed to the motor shaft, a spring plate 93 disposed to engage with the cam, and a hammer 94 fixed to the spring plate. The plate 93 is fixed at one end to the supporting plate 95 so that the hammer 94 may be positioned adjacent to a protrusion 95 formed in the inner surface of the gong wall, thereby making it possible for the hammer 94 to strike the protrusion 95.

Figure 13:
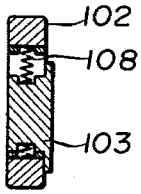
FIGS. 13, 14 and 15 are sectional side view and a plan views showing a hammer and a collar between which a resilient means are arranged.
Figure 14:
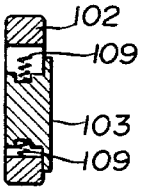
Figure 15:
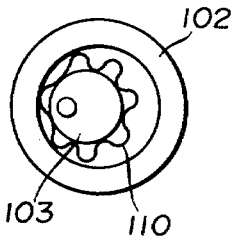

FIGS. 11, 12, 13, 14 and 15 illustrate a fifth embodiment of the invention in which numeral 101 designates a gong. A supporting plate 106 is fixedly connected to the gong 101. One end of the plate 106 receives at a motor 105 while the other end of plate 106 receives the shaft 104. A collar 103 is fixedly attached to the shaft 104 between the ends of plate 106 in such a manner that it is offset from the center of the collar 103 so as to strike a protrusion 107 formed on the inside wall of gong 101 with a hammer 102 once every rotation of the motor shaft. The hammer 102 has a cylindrical shape and is disposed around the collar 103 at a predetermined space distance from the collar 103. The hammer 102 is prevented from being removed from the collar 103 during rotation by a rim integrally made at the top edge thereof furthest from the motor. At the clearance between the collar 103 and the hammer 102, there is provided resilient means which partially absorbs the shock resulting from the striking motion of the hammer 102 against the protrusion 107. The resilient means are exemplified as depicted in FIGS. 13, 14 and 15 in such a manner that the hammer 102 and the collar 103 are resiliently supported to each other by springs 108 which are fixed at each end to grooves formed in the hammer 102 or the collar 103 (FIG. 13), by; or springs 109 which are fixed at one end to a groove formed in the collar 103 and having the other end free (FIG. 14), or by employing a shock absorber such as a spring wire 110 or a plate spring which is fixed around the collar surface by an appropriate fixing means such as a bonding agent (FIG. 15).

The operation of the gong striking mechanism thus constructed will be described.

Upon energization of the motor, its rotary shaft is rotated so that the cylindrical cam 36, the flexible tube 74, the eccentric cam 92 or the collar 103 is urged to rotate around the shaft, thereby causing the hammer 39, the eccentric cam 75, the hammer 94 or the hammer 102 to move reciprocally relative to the gong 30 or the protrusions 76, 95, respectively in order to generate bell sounds. Each time the hammer 39, the eccentric cam 75, the hammer 94 or the hammer 102 strikes the gong 30 or the protrusions 76, 95, 107, impact forces are exerted upon the hammer 39, the eccentric cam 75, the hammer 94 or the hammer 102. Impact forces are absorbed in part by the resilient means and cause no damage to the motor shaft by eliminating the possible bending force applied to the shaft.

As is described above, it is a feature of the invention to provide a bell striking mechanism in which driving power for a hammer to strike a gong is supplied from a motor by a conversion means rotationally connected directly or indirectly to the motor shaft. The conversion means in one embodiment of the invention preferably comprises a cylindrical end cam rotatably attached to the motor shaft, and cylindrical cam follower on one end of which the end surface of the cam abuts and to the other end of which a reciprocal rod having at the end portion thereof a hammer to strike the gong is fixedly connected. It is another feature of the invention to provide a bell striking mechanism in which a resilient means is disposed between the motor and a hammer so that impact forces imparted on the hammer during bell striking motion may be absorbed to some extent, thereby causing no damage to the motor shaft.

Having described our invention as related to the embodiment shown in the accompanying drawings, it is our intention that the invention is not limited by any of the details of description, unless otherwise specified, but rather is construed broadly within its spirit and scope as set out in the accompanying claims.

What is claimed is:

1. A motor actuated bell which comprises:

(a) a gong;

(b) a mounting frame affixed to and positioned substantially within the interior surface of said gong, said mounting frame being formed with three openings;

(c) an electric motor having a rotatable drive shaft, said motor being mounted on said mounting frame such that one end of said drive shaft extends through the first of said openings formed in said mounting frame;

(d) a cylindrical cam having a first end mounted on said end of said drive shaft which extends through the first of said three openings formed in said mounting frame and having a second end terminating in a cam surface;

(e) a hammer having a first end adjacent to the interior surface of the gong for striking said gong, said hammer being slidably supported through the second and third of said three openings formed in said mounting frame, the second end of said hammer being in continuous contact with said cam surface for smoothly converting the rotational movement of said drive shaft to reciprocal movement of said hammer, the axes of said drive shaft and said hammer being substantially parallel to each other; and (f) means for absorbing the impact of said hammer, said means acting in conjunction with said hammer and said cam to cause said hammer to reciprocally strike the inner surface of said gong, said impact absorbing means for acting in conjunction with said hammer and said cam being fixed at a first end to a point on said mounting frame closest to said gong and at a second end to a point on said hammer intermediate the second and third openings formed in said mounting frame.

2. A motor actuated bell which comprises:

(a) a gong;

(b) a mounting frame attached to and positioned substantially within the interior surface of said gong; said mounting frame being formed with two openings;

(c) an electric motor having a rotatable drive shaft, said motor being mounted on said mounting frame and said drive shaft being positioned for rotation between the two openings formed in said mounting frame;

(d) a collar mounted on said drive shaft intermediate the two openings formed in said mounting frame for rotation with said drive shaft, said collar being in eccentric relation with said drive shaft and being formed with an integral circular rim at the circumferential edge thereof located furthest from said motor.

(e) a cylindrical hammer having an inner surface and an outer surface, the inner diameter of said hammer being greater than the outer diameter of said circular rim, said hammer being resiliently supported in spaced apart relation to said collar by resilient means positioned on the inner surface of said hammer; and (f) said resilient means being positioned between the inner surface of said hammer and the outer surface of said collar to minimize the impact force on the drive shaft when the outer surface of said hammer strikes said gong.

3. A motor actuated bell according to claim 1 wherein said impact absorbing means for acting in conjunction with said hammer and said cam comprises a spring.

4. A motor actuated bell according to claim 2 wherein said resilient means comprises at least one spring.

* * * * *